US011235349B2

(12) United States Patent
Eliason et al.

(10) Patent No.: US 11,235,349 B2
(45) Date of Patent: Feb. 1, 2022

(54) DEVICES FOR COATING CONTOURED SURFACES

(71) Applicant: 3M INNOVATIVE PROPERTIES COMPANY, St. Paul, MN (US)

(72) Inventors: Kevin M. Eliason, River Falls, WI (US); John I. Escoto, Jr., Houston, TX (US); Patrick J. Hager, Woodbury, MN (US); Stephen C. P. Joseph, Woodbury, MN (US); Dominic M. Pitera, Minneapolis, MN (US); Steven R. Raphaelson, Watertown, MA (US); Larry A. Schleif, Monticello, MN (US); Jeffrey J. Schwab, Inver Grove Heights, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 6 days.

(21) Appl. No.: 16/137,928

(22) Filed: Sep. 21, 2018

(65) Prior Publication Data

US 2019/0022696 A1 Jan. 24, 2019

Related U.S. Application Data

(62) Division of application No. 14/411,193, filed as application No. PCT/US2013/044421 on Jun. 6, 2013, now abandoned.

(Continued)

(51) Int. Cl.

| | |
|---|---|
| ***B05D 1/28*** | (2006.01) |
| ***B05C 17/12*** | (2006.01) |
| ***B05C 17/00*** | (2006.01) |

(52) U.S. Cl.

CPC ..... *B05C 17/12* (2013.01); *B05C 17/00* (2013.01); *B05D 1/28* (2013.01)

(58) Field of Classification Search

USPC ..... 427/429, 428.01–428.07

See application file for complete search history.

(56) References Cited

U.S. PATENT DOCUMENTS

| | | | |
|---|---|---|---|
| 212,844 | A | 3/1879 | Freeman |
| 214,593 | A | 4/1879 | Sibley |

(Continued)

FOREIGN PATENT DOCUMENTS

| | | |
|---|---|---|
| CA | 1299793 | 4/1992 |
| DE | 3715928 | 7/1988 |

(Continued)

OTHER PUBLICATIONS

International Search Report for PCT International Application No. PCT/US2013/044421 dated Sep. 6, 2013, 4 pages.

(Continued)

*Primary Examiner* — Brian K Talbot

(74) *Attorney, Agent, or Firm* — Jonathan V. Sry

(57) ABSTRACT

Provided are devices for coating a contoured surface or a three-dimensional structure, and methods of making and using the same. The devices have geometries that are in point contact with the contoured surface. The geometries are substantially rigid and are provided by a flexible applicator. In this way, the flexible applicator permits conformance to the surface contours, along with rigid point contact that provides uniform and consistent coverage of liquid material. Specifically, the devices comprise a handle and an applicator pliantly affixed to the handle, the applicator comprising a plurality of spaced geometries. The devices meter film-forming coating liquids onto contoured surfaces or three-dimensional structures to form uniform coatings and resulting uniform films.

18 Claims, 4 Drawing Sheets

Related U.S. Application Data

(60) Provisional application No. 61/663,959, filed on Jun. 25, 2012.

(56) References Cited

U.S. PATENT DOCUMENTS 1,657,752 A 1/1928 Herzberg
2,265,972 A * 12/1941 Pearson ..... A45D 24/26 132/114
2,333,801 A 11/1943 Lowston
3,032,803 A 5/1962 Walshauser
3,204,278 A * 9/1965 Lambros ..... B05C 17/00 15/244.1
3,459,577 A 8/1969 Weibel
3,676,888 A 7/1972 Akers
3,706,589 A 12/1972 Fukuda
3,739,419 A 6/1973 Natman
3,769,058 A 10/1973 Bayer
3,798,702 A 3/1974 Plauda
3,803,662 A 4/1974 Gleif
3,823,024 A 7/1974 Cogliano
3,826,581 A 7/1974 Henderson
3,916,472 A 11/1975 Cader
3,946,700 A 3/1976 Cromeens
3,955,260 A 5/1976 Sherden
3,959,191 A 5/1976 Kehr
4,097,951 A 7/1978 Hurtt
4,106,154 A 8/1978 Forsberg
4,196,235 A 4/1980 Lindqvist
4,201,801 A 5/1980 Hori
4,250,586 A * 2/1981 Timian ..... B05C 17/002 15/22.1
4,398,839 A * 8/1983 Kluck ..... B05C 17/12 15/244.1
4,399,170 A 8/1983 Janssen
4,444,939 A 4/1984 Postle
4,602,401 A 7/1986 Holroyd
4,632,848 A 12/1986 Gosset
4,748,049 A 5/1988 Charles
4,774,109 A 9/1988 Hadzimihalis
4,830,922 A 5/1989 Sparrowhawk
D301,885 S 6/1989 Takemata
4,868,017 A 9/1989 Hammon
4,889,413 A 12/1989 Ormsby
4,926,519 A 5/1990 Podlesny
4,963,045 A 10/1990 Wilcox
5,028,350 A 7/1991 Marsek
5,064,475 A 11/1991 Bernasconi
5,078,527 A 1/1992 Bell
5,106,221 A 4/1992 Diot
5,117,529 A * 6/1992 Ohta ..... B05C 17/0207 15/230.11
5,127,974 A 7/1992 Tomiyama
5,186,978 A 2/1993 Woodhall
5,294,278 A 3/1994 Matsui
5,330,787 A 7/1994 Berlin
5,379,479 A 1/1995 Nelson
5,524,316 A 6/1996 Johnson
5,524,537 A 6/1996 Van der Meulen
5,588,476 A 12/1996 Trethewey
5,599,393 A * 2/1997 Elvidge ..... D21H 25/12 118/117
5,606,763 A 3/1997 South
5,660,632 A 8/1997 Volpe, Jr.
5,681,387 A 10/1997 Schmidt
5,693,141 A 12/1997 Tramont
5,702,772 A 12/1997 Skelly
5,716,667 A 2/1998 Kashiwada
5,723,185 A 3/1998 Beier
5,747,572 A 5/1998 Kashiwada
5,750,189 A 5/1998 Svensson
5,771,525 A 6/1998 Fulcher
5,829,507 A 11/1998 Pawlowski
5,836,040 A 11/1998 Giacomelli
5,851,618 A 12/1998 Liddell
5,863,599 A 1/1999 Lew
5,965,195 A 10/1999 Muller
5,975,696 A 11/1999 Kohan
6,035,806 A * 3/2000 Lorenzo ..... A01K 13/002 119/603
6,124,044 A 9/2000 Swidler
6,187,377 B1 2/2001 Tojo
6,251,468 B1 6/2001 Balter
6,295,689 B1 10/2001 Sciacca
6,312,180 B1 11/2001 Panda
6,348,235 B1 2/2002 Cavill et al.
6,394,681 B1 5/2002 Moore
6,453,909 B1 * 9/2002 De Laforcade ..... A45D 19/02 132/208
6,458,441 B1 10/2002 Storch
6,536,828 B2 3/2003 Love
6,641,664 B1 * 11/2003 Giallourakis ..... B05C 17/00 118/264
6,652,907 B1 11/2003 Steve
6,729,788 B2 5/2004 Bouveresse
6,849,328 B1 2/2005 Medwick
7,614,341 B1 11/2009 Pai
7,662,433 B2 2/2010 Ford
7,703,179 B2 4/2010 Ferguson
8,689,808 B2 * 4/2014 Gueret ..... A45D 40/267 132/218
8,834,054 B2 * 9/2014 Gallardo ..... A46B 9/12 401/193
8,916,233 B2 12/2014 Mosse et al.
2001/0055511 A1 12/2001 Baumann
2002/0001636 A1 * 1/2002 Holloway ..... B05C 17/00 425/385
2002/0010234 A1 1/2002 Rheenen
2002/0071711 A1 6/2002 Vito
2003/0027010 A1 2/2003 Olson
2003/0044220 A1 3/2003 Vito
2003/0072602 A1 4/2003 Gueret
2003/0072948 A1 4/2003 Krepski
2003/0086747 A1 5/2003 Baumann
2003/0168006 A1 9/2003 Williams
2003/0198782 A1 10/2003 Hewlett
2004/0049874 A1 3/2004 Velasquez
2004/0063596 A1 4/2004 Gabric
2004/0076788 A1 * 4/2004 Steinhardt ..... B32B 27/00 428/57
2004/0114988 A1 6/2004 Baumann
2004/0180136 A1 9/2004 Nagase
2005/0020722 A1 1/2005 Woodhall
2005/0034261 A1 2/2005 Capoccia
2005/0051360 A1 3/2005 Su
2005/0104408 A1 5/2005 Capps
2005/0135869 A1 6/2005 Liberatore
2005/0188485 A1 9/2005 McKay
2005/0244744 A1 11/2005 Kazmaier
2006/0008585 A1 1/2006 Woodhall
2006/0062923 A1 3/2006 Dilley
2006/0079158 A1 4/2006 Cooper et al.
2006/0115992 A1 6/2006 Ohishi
2006/0123579 A1 6/2006 Hellerman
2006/0168753 A1 8/2006 Crisswell
2006/0198952 A1 9/2006 Nagase
2007/0009656 A1 1/2007 Nagase
2007/0020029 A1 1/2007 Baumann
2007/0061988 A1 3/2007 Hurley
2007/0098478 A1 * 5/2007 Miyaoka ..... B05C 17/00 401/129
2007/0112126 A1 5/2007 Warren
2007/0189840 A1 8/2007 Liberatore
2007/0207269 A1 9/2007 Woodhall
2007/0281072 A1 * 12/2007 O'Connor ..... B05C 11/025 427/2.1
2007/0292201 A1 12/2007 Greer, Jr.
2008/0050563 A1 2/2008 Bellmann
2008/0152820 A1 6/2008 Witteler
2008/0187760 A1 8/2008 Wiand
2008/0268140 A1 10/2008 Akhtar
2008/0289750 A1 11/2008 Kanai
2009/0017202 A1 1/2009 Daniel

(56) References Cited

U.S. PATENT DOCUMENTS

| | | | | |
|---|---|---|---|---|
| 2009/0044897 | A1 | 2/2009 | Thomsen | |
| 2009/0100624 | A1* | 4/2009 | MacCormick | A46B 9/02 15/223 |
| 2009/0130454 | A1 | 5/2009 | Ogino | |
| 2009/0255424 | A1 | 10/2009 | Kusunoki | |
| 2009/0305047 | A1 | 12/2009 | Woronuk | |
| 2009/0308309 | A1* | 12/2009 | Aziz | B05C 17/0207 118/264 |
| 2010/0009084 | A1 | 1/2010 | Ohishi | |
| 2010/0009215 | A1 | 1/2010 | Woodhall | |
| 2010/0125961 | A1 | 5/2010 | Tuman | |
| 2010/0143594 | A1 | 6/2010 | Grau | |
| 2011/0051223 | A1 | 3/2011 | Knowles | |
| 2011/0129644 | A1 | 6/2011 | Rule | |
| 2011/0200818 | A1 | 8/2011 | Djunaidi | |
| 2012/0318192 | A1* | 12/2012 | Yamazaki | H01M 4/0404 118/200 |
| 2013/0001830 | A1 | 1/2013 | Endle | |

FOREIGN PATENT DOCUMENTS

| | | | |
|---|---|---|---|
| DE | 9210248 | U1 | 9/1993 |
| DE | 19652728 | | 6/1997 |
| DE | 19549582 | | 11/1998 |
| DE | 19827234 | | 12/1999 |
| DE | 19909245 | | 8/2000 |
| DE | 10350444 | | 6/2005 |
| EP | 0311730 | | 4/1989 |
| EP | 0902815 | | 3/1999 |
| EP | 1333938 | | 8/2003 |
| EP | 1996656 | | 12/2008 |
| EP | 2308606 | | 4/2011 |
| FR | 2747326 | | 10/1997 |
| FR | 2923402 | A1 | 5/2009 |
| GB | 798333 | | 7/1958 |
| GB | 848193 | | 9/1960 |
| GB | 1426361 | | 2/1976 |
| GB | 2037946 | | 7/1980 |
| GB | 2072538 | | 10/1981 |
| GB | 2191717 | | 12/1987 |
| GB | 2216042 | | 10/1989 |
| JP | S54-121343 | U | 8/1979 |
| JP | S58120954 | A | 7/1983 |
| JP | 63-175669 | | 7/1988 |
| JP | H03-038056 | U | 4/1991 |
| JP | H03-071120 | U | 7/1991 |
| JP | 03-195790 | | 8/1991 |
| JP | 3130610 | U | 12/1991 |
| JP | 4-310271 | | 11/1992 |
| JP | 4-313366 | | 11/1992 |
| JP | 5-65437 | | 3/1993 |
| JP | 5-237436 | | 9/1993 |
| JP | 05-076571 | U | 10/1993 |
| JP | 6-200612 | | 7/1994 |
| JP | 7-289964 | | 11/1995 |
| JP | 8-319453 | | 12/1996 |
| JP | 11-1640 | | 1/1999 |
| JP | 3031547 | | 4/2000 |
| JP | 2002-79169 | | 3/2002 |
| JP | 2004-167396 | | 6/2004 |
| JP | 2005-111304 | | 4/2005 |
| JP | 2006-159079 | | 6/2006 |
| JP | 2006-160867 | | 6/2006 |
| JP | 2009-136793 | | 6/2009 |
| JP | 2009-539585 | A | 11/2009 |
| JP | 2010-258142 | | 11/2010 |
| KR | 2007-0067812 | | 6/2007 |
| SU | 482092 | | 2/1979 |
| WO | WO 97/31722 | | 9/1997 |
| WO | WO 99/62369 | | 12/1999 |
| WO | WO 2005-019281 | | 3/2005 |
| WO | WO 2007-092412 | | 8/2007 |
| WO | WO 2007/146635 | | 12/2007 |
| WO | WO 2011-101299 | | 8/2011 |

OTHER PUBLICATIONS

Smooth-On, "Durometer Shore Hardness Scale", Nov. 8, 2017, 2 pages: https://www.smooth-on.com/page/durometer-shore-hardness-scale/.

* cited by examiner

DEVICES FOR COATING CONTOURED SURFACES

CROSS REFERENCE TO RELATED APPLICATIONS

This application is a divisional application of U.S. application Ser. No. 14/411,193, filed Dec. 24, 2014, which is a national stage filing under 35 U.S.C. 371 of PCT/US2013/044421, filed Jun. 6, 2013, which claims priority to U.S. Application No. 61/663,959, filed Jun. 25, 2012, the disclosure of which is incorporated by reference in their entirety herein.

TECHNICAL FIELD

This disclosure relates to devices for coating surfaces, such as contoured surfaces. Devices are hand-held and have an applicator pliantly affixed to a handle, the applicator comprising a plurality of spaced geometries. Upon contact with a contoured surface, the geometries are in point contact with the contoured surface.

BACKGROUND

A number of products exist today that are designed to temporarily protect various surfaces or articles from incidental damage and/or environmental contaminants. Protection of automotive surfaces is of particular interest as the repair process associated with any damage to clear coats can be extensive and expensive. A current common method of protecting vehicle surfaces is with pressure sensitive adhesive backed films that are applied directly to and in intimate contact with the surface to be protected. Although these types of films (i.e. transit tapes, paint protection films) can be effective at protecting the surface from physical damage and environmental fallout (dust, insects, tar, rocks, sand, pollen, rail dust, etc.), they are very difficult to apply. These pressure sensitive adhesive backed films are two-dimensional, and when applied to typical three-dimensional vehicle surfaces, wrinkles and bubbles are formed. These wrinkles and bubbles can, and frequently are, the source of clear coat deformation issues. Also, just the presence of a pressure sensitive adhesive in intimate contact with a substrate can cause substrate deformation.

Additional products on the market include materials that can be applied to modify the appearance of the vehicle surface without painting it. Matte black films, for example, exist to change the gloss and color of the vehicle or portions of it. These films are wrought with the same application difficulties as any two dimensional film. These typically have to be applied by a professional to obtain results that are visually acceptable, and tend to be rather expensive.

Liquid-applied film-forming coatings can be used to solve some of the problems associated with applying pre-formed films onto surfaces. Liquids are infinitely conformable and, therefore, are easily applied onto a three-dimensional vehicle surface. This is a significant application advantage relative to any two dimensional pressure sensitive adhesive backed films.

Use of liquid materials, however, posses a challenge in applying it to three-dimensional surfaces of an automobile while maintaining a consistent coating thickness, especially across the entire automobile. Traditional coating applicators, including but not limited, to paint brushes, paint rollers, paint pads, standard automated paint pumps, foam rollers, foam brushes, adhesive rollers, putty knives, squeegees, and the like do not provide uniform coatings. Meyer rods, in particular, are for single-plane applications and lack suitable conformability to coat three-dimensional surfaces.

Spraying is a typical coating process for applying liquid coatings to a substrate; in particular, the body panels of an automobile. Spray application techniques and pieces of equipment include airless sprayers, air assisted airless sprayers, conventional air spray guns, HVLP air spray guns, automotive seam sealer guns, automotive Schutz guns (for undercoatings), aerosol sprayers, compressed cylinder (Northstar) sprayers, trigger bottles, and hand pump sprayers. Proper spray technique can produce a uniform and consistent coating thickness on three-dimensional substrates. With spray application of a coating, however overspray is always produced, sometimes in significant amounts. As a result, surrounding areas must be masked off to prevent the deposition of overspray droplets when spray coating a panel of interest. On automobiles, in particular, the entire vehicle is typically covered with masking to protect all adjacent surfaces. This masking process can be prohibitively expensive and time-consuming.

Therefore, it is of substantial value to be able to apply a liquid coating to a three-dimensional substrate, such as a contoured surface, uniformly and in such a way that eliminates the need for masking time and materials.

SUMMARY

Provided are devices for coating a contoured surface or a three-dimensional structure, and methods of making and using the same. The devices have geometries that are in point contact with the contoured surface. The geometries are substantially rigid and are provided by a flexible applicator. In this way, the flexible applicator permits conformance to the surface contours, along with rigid point contact that provides uniform and consistent coverage of liquid material.

In a first aspect, a device for coating a contoured surface comprises: a handle; an applicator pliantly affixed to the handle, the applicator comprising a plurality of spaced geometries; wherein upon contact with the contoured surface, the geometries are in point contact with the contoured surface.

In one embodiment, the applicator comprises a flexible microreplicated material that comprises the plurality of geometries. The geometries are rigid. The geometries of the flexible microreplicated material can be selected from the group consisting of pins, posts, cones, cylinders, pyramids, mushroom heads, cube corners, and J-hooks. Material of construction and geometry configurations can be chosen to accommodate the needs of a particular application. In one or more detailed embodiments, the geometries have a height in the range of 50 to 2000 microns (~2 to 80 mil), and/or a base diameter or width in the range of 100 to 2000 microns (~4 to 80 mil), and/or a density in the range of 50-2000 geometries per square inch (~7-310 geometries per square centimeter).

In another embodiment, the applicator comprises a spring and the geometries comprise coils of the spring. The springs can be coated to provide a non-scratch surface. Devices formed with a spring application can further comprise a biaser, which facilitates coating of concave surfaces. Exemplary biasers include another spring perpendicular to the applicator spring to provide an outward force. Another biaser can be a support structure, such as tubing, within the coils of the spring. Such devices can also further comprise a tensioner that is effective to vary coil-to-coil distance of the spring.

In embodiments provided herein, the geometries are effective to meter a substantially uniform layer of a film-forming coating liquid onto the contoured surface.

The geometries are also effective to avoid marring the contoured surfaces. For coating of vehicle panels, the devices do not scratch the clear coat.

In a detailed aspect, provided are devices for coating a contoured surface comprising: a handle; a microreplicated flexible material on a non-rigid backing, the microreplicated flexible material being pliantly affixed to the handle by the non-rigid backing and having a plurality of spaced geometries; wherein upon contact with the contoured surface, the geometries are in point contact with the contoured surface. In one embodiment, the non-rigid backing comprises a foamed pad. In another embodiment, the non-rigid backing comprises a spring.

Another aspect provides a method for coating a contoured surface, the method comprising: providing a device comprising a handle and an applicator pliantly affixed to the handle, the applicator comprising a plurality of spaced geometries; and using the device to apply a film-forming coating liquid to the contoured surface, wherein the geometries are in point contact with the contoured surface. The geometries are effective to meter a uniform layer of the film-forming coating liquid onto the contoured surface.

A further aspect provides a method for forming a uniform film on a three-dimensional structure, the method comprising: loading a device with a film-forming coating liquid, the device comprising a handle and an applicator pliantly affixed to the handle, the applicator comprising a plurality of spaced geometries; metering the film-forming coating liquid onto the three-dimensional substrate with the device, wherein the geometries are in point contact with the contoured surface to form a uniform liquid coating; and drying the uniform liquid coating to form a uniform film.

These and other aspects of the invention are described in the detailed description below. In no event should the above summary be construed as a limitation on the claimed subject matter.

BRIEF DESCRIPTION OF THE DRAWINGS

The disclosure may be more completely understood in consideration of the following detailed description of various embodiments of the disclosure in connection with the accompanying drawings, in which.

DETAILED DESCRIPTION

Figure 1:
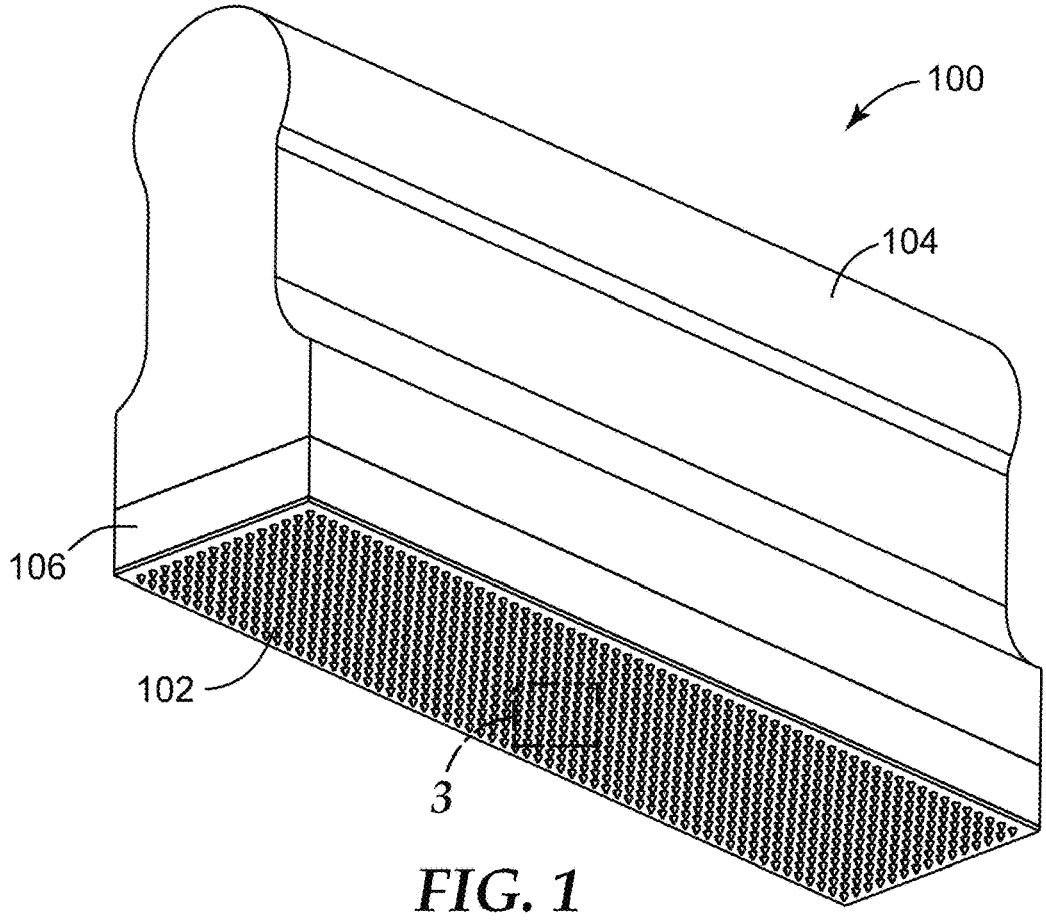
FIG. 1 is schematic of a device according an embodiment.

Before describing several exemplary embodiments of the invention, it is to be understood that the invention is not limited to the details of construction or process steps set forth in the following description. The invention is capable of other embodiments and of being practiced or being carried out in various ways.

Devices provided herein apply liquid coatings to three-dimensional structures, such as contoured surfaces of vehicle panels or industrial equipment such as fan blades, uniformly and efficiently. In this way, the inefficiencies and difficulties that accompany the use of pre-formed films or spraying can be avoided.

The following terms shall have, for the purposes of this application, the respective meanings set forth below.

"Geometries" refers to a series of structures of the same shape that are effective to be in point contact with a contoured surface. Examples of geometries include, but are not limited to, coils of a spring, upstanding stems or projections or ridges of a film layer such as pins, posts, cones, cylinders, pyramids, mushroom heads, cube corners, and J-hooks. Tips of these geometries can be configured as needed, for example, concave tips may be beneficial under certain circumstances, whereas convex tips may be beneficial under others. Geometries are rigid, that is, they generally retain their shape upon contact with the contoured surface. This is in contrast to devices, such as paint brushes or paint pads, that use bristles or filaments or napping, whose shapes are deformable.

"Pliantly affixed" means that the applicator is able to move in at least two and possibly even all three translational motions (up and down, left and right, forward and backward) while being maneuvered by the handle. For example, a spring attached at each end to two posts of a handle is pliantly affixed. Also, a flexible microreplicated material that is attached to a handle is also pliantly affixed. As needed, the flexible microreplicated material could be on a non-rigid backing. A spring attached at each end to two posts of a handle can provide a non-rigid backing. Also a foam pad on a plane of a handle can provide a non-rigid backing. Other examples of non-rigid backings include, but are not limited to silicone gel pads, nonwoven polymeric pads, paint brush bristles, and the like.

"Point contact" means that individual surfaces of the geometries of the applicator are substantially in contact with the contoured surface at individual points. This is in contrast to "line contact" where there would be a continuous line of contact between an applicator and a surface.

"Microreplicated material" refers to a material with a major surface containing raised features that are arrayed in patterns. The raised features can be outwardly projecting elastomeric elements. Suitable materials include but are not limited to polypropylene and high density polyethylene. The raised features of the microreplicated material can include the geometries discussed herein. Exemplary disclosures of how to make a microreplicated material are U.S. Pat. No. 7,703,179 and U.S. Patent Appln. Pub. No. 2011/0129644, both of which are herein incorporated by reference, commonly-owned by the applicant herein, 3M Innovative Properties Co.

A "biaser" is a structure that lends support to the applicator and provides a positive force to keep the applicator in contact with the substrate. The biaser is particularly useful to facilitate coating of concave surfaces by keeping the geometries substantially in point contact with the concave surface. A biaser can be a spring or adjustable rod or other device that pushes or biases the applicator outward from the handle.

A "tensioner" is a movable structure such as one or more slidable arms that changes the distances between coils of a spring applicator.

A "uniform" liquid coating and/or layer and/or film is one that is visually consistent in thickness and weight. Minor surface striations, undulations, or variations still render a liquid coating and/or film one that is uniform.

Reference to "meter" means that the film-forming coating liquid is supplied to the contoured surface is a measured or regulated amount. The resulting coating thickness is directly related to the configuration of the applicator. That is, for the applicators made from microreplicated material, the size of the geometries and their spacings can be tailored to deliver a desired amount of liquid to achieve a desired thickness of dried film. For applicators that are springs, the diameter of the wire forming the spring along with the spacings of the coil determine the amount of liquid to be delivered. Support structures within the spring will also impact the delivery amount.

Devices

Figure 2:
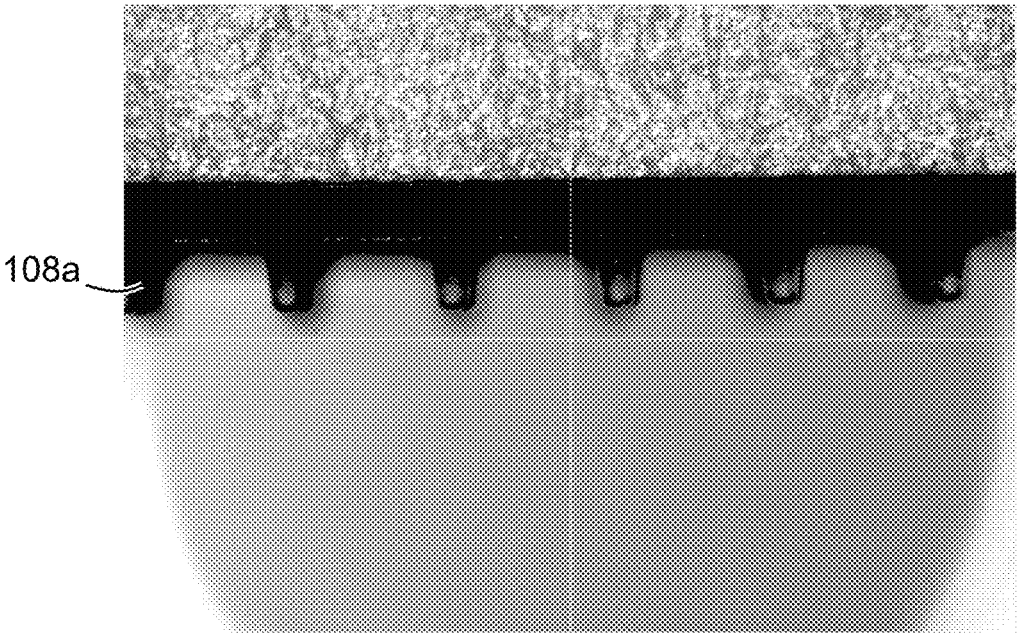
FIG. 2 is a microphotograph of a pin geometry that is on an applicator according to one embodiment.
Figure 3:
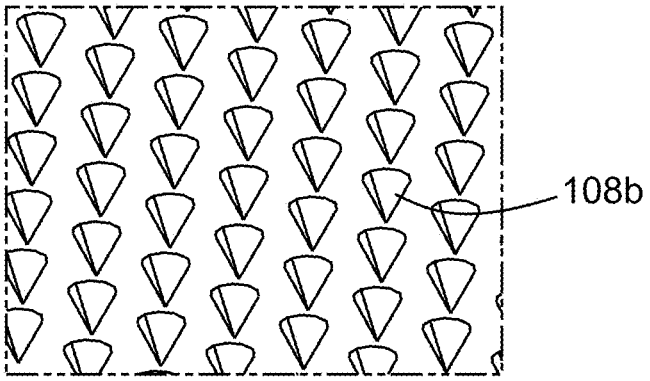
FIG. 3 shows a schematic of a cone geometry that is on an applicator according to one embodiment.

Turning to the figures, FIG. 1 is schematic of a device 100 according an embodiment where applicator 102 is pliantly affixed to the handle 104. The applicator 102 can be affixed to the handle directly (not shown) or by a non-rigid backing 106. The applicator 102 of this embodiment is a microreplicated material formed from a desired polymer such as polypropylene or high density polyethylene. FIG. 2 is a micrograph of a pin geometry 108*a* that is on the microreplicated material according to one embodiment. FIG. 3 is a schematic of a cone geometry 108*b* according to another embodiment. The geometries can have a height in the range of 50 to 2000 microns (~2 to 80 mil), or 100 to 1800 microns (~4 to 71 mil), or even 250 to 1300 microns (~8 to 30 mil). The geometries can have a base diameter or width in the range of 100 to 2000 microns (~4 to 80 mil), or 150 to 1800 microns (~6 to 71 mil), or even 50 to 800 microns (~2 to 30 mil). The geometries can be on the flexible microreplicated material at a rate in the range of 50-2000 geometries per square inch (~7-310 geometries per square centimeter).

Affixing the applicator to a non-rigid backing can be done according to need. That is, the applicator can be integral to a non-rigid backing, or permanently affixed, or even removably affixed by, for example, pressure-sensitive adhesive (PSA). In one ore more embodiments, the applicator can be disposable while the handle, and non-rigid backing as needed, can be reusable.

Figure 4:
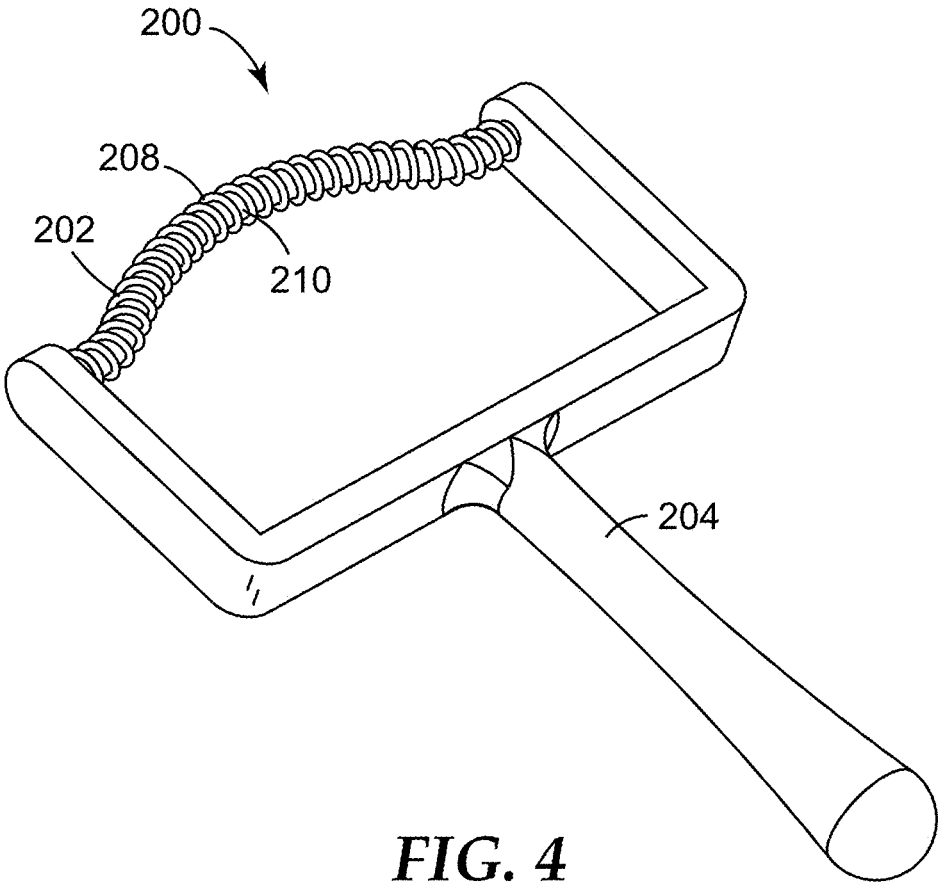
FIG. 4 shows a schematic of a device according to another embodiment.
Figure 5:
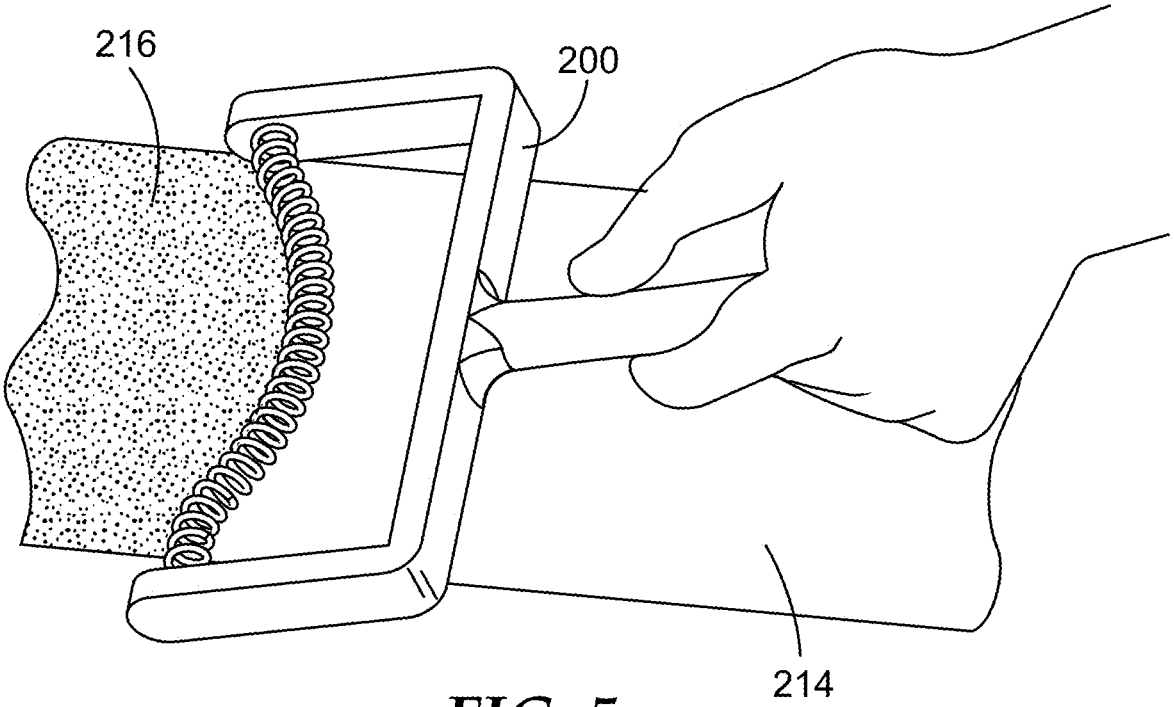
FIG. 5 shows the use of the embodiment of FIG. 4 to coat a contoured surface.
Figure 6:
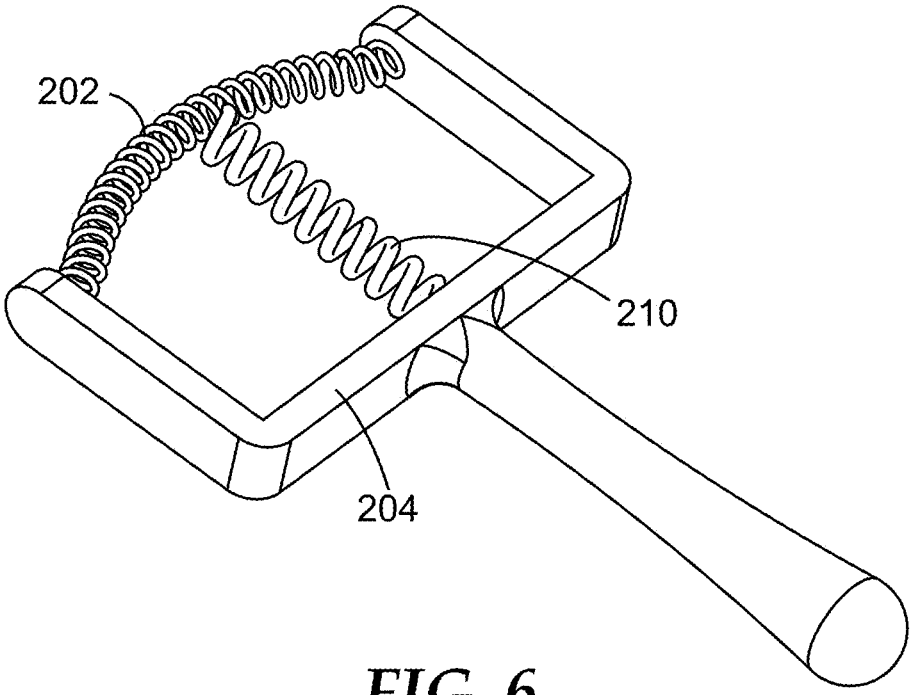
FIG. 6 is a schematic of another embodiment of a device.
Figure 7:
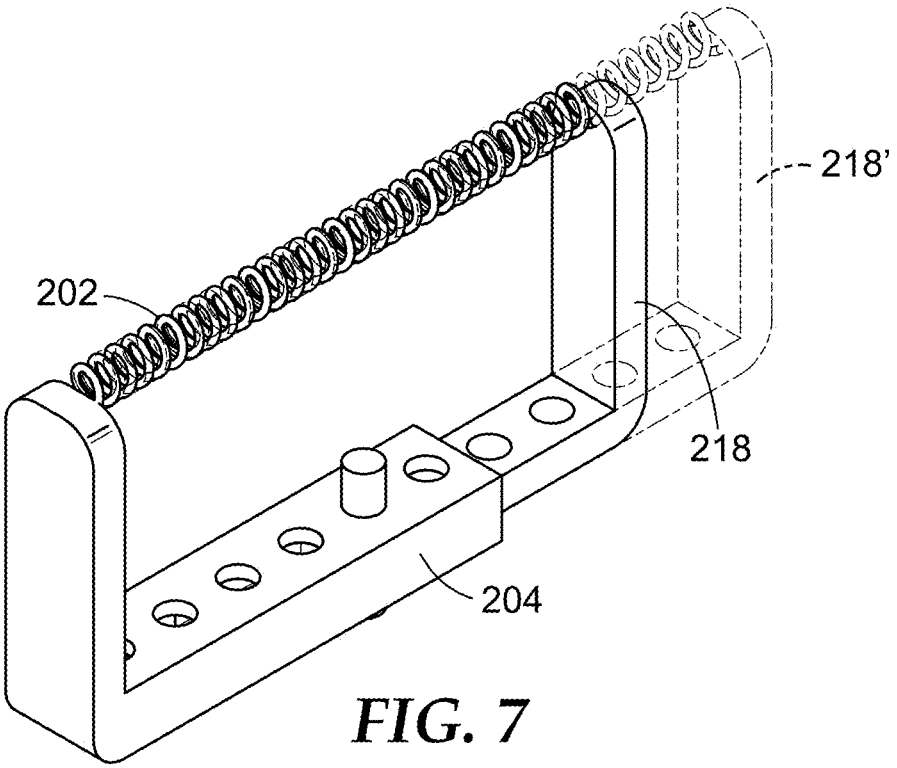
FIG. 7 is a schematic of another embodiment of a device.

In FIGS. 4 and 6, another device 200 is shown, providing an applicator 202 in the form of a spring that is pliantly affixed to handle 204. The geometries 208 of the spring are coils of desired spacing, diameter, and wire diameter. A biaser 210 pushes the spring out to facilitate coating of concave surfaces. In FIG. 5, use of device 200 is shown for applying coating 216 onto a contoured surface 214. In FIG. 7, spring applicator 202 is pliantly affixed to handle 204 and to a tensioner 218 that is movable to a new position 218' to vary the coil-to-coil distance. Spring configuration can be chosen to accommodate the needs of a particular application. Exemplary and non-limiting configurations are provided as follows. The springs can be formed of wires having a diameter in the range of 0.25-5 mm. The springs can have coil diameters in the range of 5-50 mm. The spacings of the coils can be in the range of 0.25-10 mm. The springs can be coated to provide a non-scratch surface.

Figure 8:
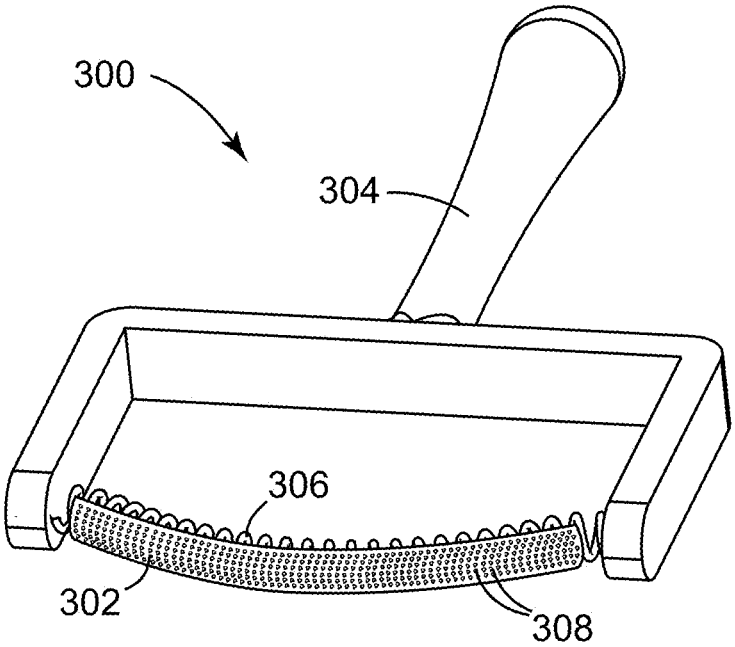
FIG. 8 is a schematic of another embodiment of a device.

FIG. 8 shows another device 300 where applicator 302 is a microreplicated material located on a non-rigid backing 306 that is a spring. The microreplicated material is pliantly affixed to handle 304 by the spring.

Film-Forming Coating Liquids and Films

Useful film-forming coating liquids are those containing a polymeric dispersion and additives as desired. For example, useful polymeric materials can include styrene, butadiene, acrylic, vinyl acetate, ethylene vinyl acetate, polyurethane, or combinations thereof. A preferred polymer is an aliphatic polyether urethane provided by Stahl USA under the trade designation "RU 13-825". The aqueous polymeric dispersion can be part of a formulated system that comprises a defoamer and/or a thickener. In particular embodiments, the polymer is non-cross-linked, and the system is free of a cross-linking agent. The formulated system can further comprise a slip aid, a dispersing agent, a UV adsorber, a hindered-amine light stabilizer, and/or an antioxidant as desired to facilitate stability, durability, and/or integrity of the resulting film.

The films themselves can vary in function, thickness, and composition based on need. For example, they can provide a protective coating on vehicles for use during transit of the vehicles. The films can also provide a tint to a substrate, for example, a window, while remaining clear to avoid visual distortion when looking through the film. One such suitable film is formed by a film-forming liquid tint material disclosed in a concurrently-filed application under Applicant's designation of Case No. 69626US002, which is incorporated herein by reference.

Unless otherwise indicated, all numbers expressing quantities of ingredients, properties such as molecular weight, reaction conditions, and so forth used in the specification and claims are to be understood as being modified in all instances by the term "about." Accordingly, unless indicated to the contrary, the numerical parameters set forth in the following specification and attached claims are approximations that may vary depending upon the desired properties sought to be obtained by the present disclosure. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the disclosure are approximations, the numerical values set forth in the specific examples are reported as precisely as possible. Any numerical value, however, inherently contain certain errors necessarily resulting from the standard deviation found in their respective testing measurements.

EXAMPLES

Unless otherwise noted, all parts, percentages, ratios, etc. in the examples and the rest of the specification are by weight, and all reagents used in the examples were obtained, or are available, from general chemical suppliers such as, for example, Sigma-Aldrich Company, Saint Louis, Mo., or may be synthesized by conventional methods.

The following abbreviations are used to describe the examples:

° C.: degrees Centigrade
cps: centipoise
° F.: degrees Fahrenheit
$g/cm^2$: grams per square centimeter
$g/m^2$: grams per square meter $in^2$: square inch
$lb/in^2$: pounds per square inch
mil: $10^{-3}$ inches
mL: milliliter
m/min: meters per minute
μm: micrometers
nm: nanometers
N: Newtons
oz: ounce
Pa·s: Pascal second Paint Protection Liquid (PPL)

The following components were used to make PPL-1 and PPL-2:

316G30SP: A polyethylene wax, obtained under the trade designation "316G30SP" from Chemcor, Chester, N.Y.

D-655: A dispersant, obtained under the trade designation "TEGO DISPERS D655" from Evonik Degussa Corporation, Parsippany, N.J.

DF-1760: A defoamer, obtained under the trade designation "DAPRO DF-1760" from Elementis Specialties, Inc., Hightstown, N.J.

DF-3163: A defoamer, obtained under the trade designation "DAPRO DF-3163" from Elementis Specialties, Inc.

RM-8W: A non-ionic rheology modifier, obtained under the trade designation "ACRYSOL RM-8W" from Dow Chemical Company, Midland, Mich.

WHD-9507: A white pigment, obtained under the trade designation "SUNSPERSE WHITE 6 WHD-9507" from Sun Chemical Corporation, Parsippany, N.J.

RU-13-825: An aqueous polyurethane dispersion, obtained under the trade designation "PERMUTEX RU-13-825" from Stahl USA, Inc., Peabody, Mass.

PPL-1: 89.5 parts by weight RU-13-825 was added to a mixing kettle at 21° C. With continuous stirring, the following components were added in 5 minute intervals: 0.52 parts DF-3163; 3.25 parts WHD-9507; 0.60 parts DF-1760; 2.91 parts 316G30SP; 2.73 parts D-655 and 0.52 parts RM-8W, after which the dispersion was mixed at high speed for 10 minutes. The resulting paint protection liquid MS-44 had a dynamic viscosity of 9,960 cps (9.96 Pa·s).

PPL-2: A paint protection liquid was prepared according to the general procedure for making PPL-1, wherein the D-655 was reduced to 0.68 parts, RM-8W was increased to 0.59 parts, and the balance made up with 1.91 parts water. The dynamic viscosity was 9,300 cps (9.3 Pa·s).

Stem Web Applicators

Sheets of thermoplastic stem web having various stem heights, density and geometry were prepared as follows. A polypropylene resin, obtained under the trade designation "3868PP" from Dow Chemical Company, Midland, Mich., was extruded using a Davis Standard Extruder DS-25, 2.5 inch extruder, serial number P7061, Screw Number XA281368LTR8332 obtained from Merritt Davis Corp., Hamden, Conn., at 210-218° C., into the cavities of mild steel patterned rolls at 21° C., according to the conditions listed in Table 1. The solidified stem web, having a target base thickness of 8 mils (203 μm), was converted to 6 by 1.5 inch sectioned (15.2 by 3.8 cm) sheets. Reference to "rounded conical" means a tapered body with a convex tip.

TABLE 1

| | Extruder Conditions | | | | Stem | | |
|---|---|---|---|---|---|---|---|
| Stem Web | Speed (m/min.) | Extruder Temp. (° C.) | Nip Pressure MA (kPa) | Nip Pressure OP (kPa) | Density (stems/$cm^2$) | Geometry | Height (mm) |
| A | 3.81 | 218.3 | 137.9 | 137.9 | 31.0 | Rounded conical | 0.46 |
| B | 3.50 | 210.0 | 206.8 | 206.8 | 31.0 | Rounded conical | 0.48 |
| C | 3.35 | 218.3 | 182.7 | 182.7 | 31.0 | Rounded conical | 0.56 |
| D | 3.66 | 218.3 | 206.8 | 206.8 | 31.0 | Rounded conical | 0.61 |
| E | 3.05 | 218.3 | 413.7 | 413.7 | 31.0 | Rounded conical | 0.76 |
| F | 3.66 | 218.3 | 275.8 | 275.8 | 31.0 | Rounded conical | 0.79 |
| G | 3.81 | 218.3 | 137.9 | 137.9 | 46.5 | Rounded conical | 0.46 |
| H | 3.50 | 210.0 | 206.8 | 206.8 | 46.5 | Rounded conical | 0.48 |
| I | 3.35 | 218.3 | 182.7 | 182.7 | 46.5 | Rounded conical | 0.56 |
| J | 3.66 | 218.3 | 206.8 | 206.8 | 46.5 | Rounded conical | 0.61 |
| K | 3.05 | 218.3 | 413.7 | 413.7 | 46.5 | Rounded conical | 0.76 |
| L | 3.66 | 218.3 | 275.8 | 275.8 | 46.5 | Rounded conical | 0.79 |
| M | 5.18 | 232.2 | 565.4 | 413.7 | 89.4 | Rounded conical | 0.41 |

Hard foam hand sanding blocks having the following open cell foam back up pads were obtained from Rogers Foam Corporation, Somerville, Mass.:

G-15A: ¼ inch (6.35 mm) thick, having an Indentation Force Deflection (IFD) of 1.80 lbs/in$^2$ (126.6 g/cm$^2$) at 25% compression.

G-15B: ½ inch (12.7 mm) thick, IFD of 1.80 lbs/in$^2$ (126.6 g/cm$^2$) at 25% compression.

G-60: ½ inch (12.7 mm) thick, IFD of 1.20 lbs/in$^2$ (84.4 g/cm$^2$) at 25% compression.

1544: ¾ inch (19.05 mm) thick, IFD of 0.88 lbs/in$^2$ (61.9 g/cm$^2$) at 25% compression.

1235: ¾ inch (19.05 mm) thick, IFD of 0.70 lbs/in$^2$ (49.2 g/cm$^2$) at 25% compression.

The stem web samples were cemented to the face of the foam back up pad using a 2-part adhesive, obtained under the trade designation "PLASTIC REPAIR SEALER" from 3M Company.

Various applicator constructions were used to apply paint protection liquids onto a 12 by 12 inch (25.4 by 25.4 cm) painted and clear coated steel test panel, type "APR 50405" obtained from ACT Laboratories, Inc., Hillsdale, Mich. The resulting coating thickness, using a wet film thickness gauge, and coating quality, subjectively ranked on a scale of 1-5, wherein the higher number represented higher coating quality, are reported in Table 2.

TABLE 2

| Stem Web | Foam | PPL | Average Wet Thickness (mm) | Coating Quality Scale 1-5 (poor-excellent) |
|---|---|---|---|---|
| A | G-15B | PPL-1 | 0.36 | 5.0 |
| B | G-15B | PPL-1 | 0.31 | 3.0 |
| C | G-60 | PPL-1 | 0.32 | 4.0 |

TABLE 2-continued

| Stem Web | Foam | PPL | Average Wet Thickness (mm) | Coating Quality Scale 1-5 (poor-excellent) |
|---|---|---|---|---|
| D | G-60 | PPL-1 | 0.24 | 5.0 |
| E | G-15B | PPL-1 | 0.29 | 3.0 |
| F | G-60 | PPL-1 | 0.33 | 4.5 |
| G | G-15B | PPL-1 | 0.29 | 4.5 |
| H | G-15B | PPL-1 | 0.24 | 4.0 |
| I | G-60 | PPL-1 | 0.19 | 4.0 |
| J | G-60 | PPL-1 | 0.20 | 4.0 |
| K | G-15B | PPL-1 | 0.24 | 4.0 |
| L | G-60 | PPL-1 | 0.28 | 5.0 |
| M | 1544 | PPL-1 | 0.25 | 4.0 |
| M | G-15A | PPL-1 | 0.25 | 5.0 |
| D | G-60 | PPL-2 | 0.23 | 3.0 |
| H | G-60 | PPL-2 | 0.28 | 2.0 |

Spring Applicators

The following springs were obtained from Century Spring Corporation located at 222 E. 16$^{th}$ Street P.O. Box 15287, Los Angeles, Calif. 90015 a division of MW Industries, Inc. Springs were used to construct various applicators, according to the coil dimensions listed in Table 3:

SA-01: A extension spring obtained from Century Spring Corporation;

SA-02: A compression spring obtained from Century Spring Corporation;

SA-03: A extension spring obtained from Century Spring Corporation; and

SA-04: A extension spring obtained from Century Spring Corporation.

TABLE 3

| | | Dimensions | | | | Physical Characteristics | |
|---|---|---|---|---|---|---|---|
| Applicator ID | Spring Stock # | OD (mm) | Free Length (mm) | Wire Diameter (mm) | Extension or Compression Length (mm) | Spring Rate (N/m) | Material |
| SA-01 | CSC 5833 | 15.8 | 171.5 | 1.37 | 228.6 | 11.21 | Hard Drawn |
| SA-02 | CSC S-3182* | 12.29 | 304.8 | 0.79 | 132.08 | 17.51 | Stainless |
| SA-03 | CSC 137 | 22.23 | 222.3 | 1.57 | 323.85 | 57.80 | Hard Drawn Powder Coated |
| SA-04-0 Extension = 0 in | CSC 119 | 11.10 | 215.9 | 1.19 | 215.9 | 127.84 | Hard Drawn |
| SA-04-2 Extension = 2 in (50.8 mm) | CSC 119 | 11.10 | 215.9 | 1.19 | 266.7 | 127.84 | Hard Drawn |
| SA-04-4 Extension = 4 in (101.6 mm) | CSC 119 | 11.10 | 215.9 | 1.19 | 317.5 | 127.84 | Hard Drawn |
| SA-04-6 Extension = 6 in (152.4 mm) | CSC 119 | 11.10 | 215.9 | 1.19 | 368.3 | 127.84 | Hard Drawn |

*free length cut to 5.6 in (142.2 mm) for SA-02

Using the spring applicators above, paint protection liquids MS-44 (PPL-1) were applied to various contoured surfaces of vehicles. The coating variables, and corresponding wet thickness and coating quality, are listed in Table 4.

TABLE 4

| Spring Applicator | Body Panel | Wet Thickness mm | Coating Quality Scale 1-5 (poor-excellent) |
|---|---|---|---|
| SA-01 | Hood | 0.25 | 4.5 |
| SA-02 | Hood | 0.28 | 5.0 |
| SA-03 | Hood | 0.28 | 5.0 |
| SA-04-0 | Flat Panel | 0.08 | 5.0 |
| SA-04-02 | Flat Panel | 0.18 | 5.0 |
| SA-04-04 | Flat Panel | 0.23 | 5.0 |
| SA-04-06 | Flat Panel | 0.36 | 5.0 |

Reference throughout this specification to "one embodiment," "certain embodiments," "one or more embodiments" or "an embodiment" means that a particular feature, structure, material, or characteristic described in connection with the embodiment is included in at least one embodiment of the invention. Thus, the appearances of the phrases such as "in one or more embodiments," "in certain embodiments," "in one embodiment" or "in an embodiment" in various places throughout this specification are not necessarily referring to the same embodiment of the invention. Furthermore, the particular features, structures, materials, or characteristics may be combined in any suitable manner in one or more embodiments.

Although the invention herein has been described with reference to particular embodiments, it is to be understood that these embodiments are merely illustrative of the principles and applications of the present invention. It will be apparent to those skilled in the art that various modifications and variations can be made to the method and apparatus of the present invention without departing from the spirit and scope of the invention. Thus, it is intended that the present invention include modifications and variations that are within the scope of the appended claims and their equivalents.

What is claimed is:

1. A method for coating a contoured surface, the method comprising:

providing a device comprising a handle and an applicator pliantly affixed to the handle, the applicator comprising a plurality of spaced geometries; and using the device to apply a film-forming coating liquid to the contoured surface, wherein the geometries are in point contact with the contoured surface, and wherein the geometries are rigid such that they retain their shape upon contact with the contoured surface.

2. The method of claim 1, wherein the geometries are effective to meter a uniform layer of the film-forming coating liquid onto the contoured surface.

3. The method of claim 1, wherein the geometries are effective to avoid marring the contoured surface.

4. The method of claim 1, wherein the applicator comprises a flexible microreplicated material that comprises the plurality of geometries.

5. The method of claim 4, wherein the geometries are selected from the group consisting of pins, posts, cones, cylinders, pyramids, mushroom heads, cube corners, and J-hooks.

6. The method of claim 4, wherein the geometries have a height in the range of 50 to 2000 microns.

7. The method of claim 4, wherein the geometries have a base diameter or width in the range of 100 to 2000 microns.

8. The method of claim 4, wherein the geometries are on the flexible microreplicated material at a rate in the range of 50-2000 geometries per square inch.

9. The method of claim 1, wherein the applicator comprises a spring and the geometries comprise coils of the spring.

10. The method of claim 9, wherein the spring is coated to provide a non-scratch surface.

11. The method of claim 9, wherein the device further comprises a biaser.

12. The method of claim 9, wherein the device further comprises a tensioner that is effective to vary coil-to-coil distance of the spring.

13. The method of claim 1, wherein upon contact with the contoured surface, the geometries are effective to meter a substantially uniform layer of a film-forming coating liquid onto the contoured surface.

14. The method of claim 1, wherein the geometries are effective to avoid marring the contoured surface.

15. The method of claim 4, wherein the flexible microreplicated material is on a non-rigid backing comprising a foamed pad and the microreplicated flexible material is pliantly affixed to the handle by the non-rigid backing.

16. The method of claim 4, wherein the flexible microreplicated material is on a non-rigid backing comprising a spring and the microreplicated flexible material is pliantly affixed to the handle by the non-rigid backing.

17. A method for forming a uniform film on a three-dimensional structure, the method comprising:

loading a device with a film-forming coating liquid, the device comprising a handle and an applicator pliantly affixed to the handle, the applicator comprising a plurality of spaced geometries;

metering the film-forming coating liquid onto the three-dimensional substrate with the device, wherein the geometries are in point contact with a contoured surface to form a uniform liquid coating, and wherein the geometries are rigid such that they retain their shape upon contact with the contoured surface; and drying the uniform liquid coating to form a uniform film.

18. The method of claim 17, wherein the applicator comprises a microreplicated flexible material on a non-rigid backing, the microreplicated flexible material being pliantly affixed to the handle by the non-rigid backing.

* * * * *